United States Patent [19]

Stormberg et al.

[11] Patent Number: 4,987,345

[45] Date of Patent: Jan. 22, 1991

[54] CHARGED PARTICLE SOURCE OF LARGE CURRENT WITH HIGH ENERGY

[75] Inventors: Hans-Peter Stormberg, Stolberg, Fed. Rep. of Germany; Yoshio Watanabe; Isao Ochiai, both of Tokyo, Japan

[73] Assignee: U.S. Philips Corporation, New York, N.Y.

[21] Appl. No.: 216,938

[22] Filed: Jul. 8, 1988

[30] Foreign Application Priority Data

Jul. 10, 1987 [JP] Japan ..... 62-170957

[51] Int. Cl.[5] ..... H05H 1/24

[52] U.S. Cl. ..... 315/111.21; 315/111.31; 315/111.81; 250/396 R; 250/423 R; 313/231.31

[58] Field of Search ..... 315/111.31, 111.41, 315/111.81, 111.21; 250/396 R, 396 ML, 423 R; 313/231.31

[56] References Cited

U.S. PATENT DOCUMENTS

| | | | |
|---|---|---|---|
| 3,329,865 | 7/1967 | Jaatinen | 315/111.41 |
| 3,579,027 | 5/1971 | Pater | 315/111.41 |
| 4,447,773 | 5/1984 | Aston | 315/111.31 X |
| 4,710,632 | 12/1987 | Ishitani et al. | 250/369 R |
| 4,737,688 | 4/1988 | Collins et al. | 315/111.31 X |
| 4,800,281 | 1/1989 | Williamson | 250/423 R X |

*Primary Examiner*—Eugene R. LaRoche
*Assistant Examiner*—Do Hyun Yoo
*Attorney, Agent, or Firm*—Paul R. Miller

[57] ABSTRACT

A plasma ion source comprises coaxially oriented electrodes of which a first electrode has the shape of a rod and a second electrode an annular shape, positioned in a space filled with a gas of atomic number greater than that of Boron, a current source up to 100 KA to be reacted within 1 usec and structure for focussing ions located near a formed pinch plasma.

2 Claims, 1 Drawing Sheet

CHARGED PARTICLE SOURCE OF LARGE CURRENT WITH HIGH ENERGY

This invention relates to an ion source with high energy (electron source), and more particularly to a charged particle source of a large current with high energy which exhibits a high peak value and is suitable for generating multi-ionized ions.

BACKGROUND OF THE INVENTION

An article in Japanese Journal of Applied Physics, Vol.24, No.3 (1985), pp.324-327 discusses the generation of high energy particles in a Mather type plasma focus device. The electrode structure in this prior art reference is of a coaxial double type and the polarity of an inner electrode is positive. Deuterium is used as an operating gas, and a measured value of particles emitted in an axial direction when a source voltage (capacitor voltage) is 65 KV is disclosed. In other words, X-rays, electrons, neutrons (2.45 MeV) and a deuterium beam (1 KeV to 170 KeV) are observed in the axial direction.

The prior art reference described above discloses that emission of charged particles can be obtained by use of a Mather type plasma focus device, but the reference does not describe how high efficiency can be attained while securing multi-ionized ions when the device is used as a particle source.

SUMMARY OF THE INVENTION

It is therefore an object of the present invention to provide a particle source providing high efficiency and containing multi-ionized ions.

To accomplish the object described above, the present invention employs the following construction.

The electrode structure of the discharge tube in the present invention is such that the electrodes are disposed in a coaxially symmetric relation with each other but asymmetrically in an axial direction, one of the electrodes does not have any hole at the center and even if it does, the hole diameter is up to 10 mm, while the other electrode has a hole having a diameter of at least 40 mm at the center.

The polarity of the electrode not having the hole is negative when obtaining an electron beam and is positive when obtaining an ion beam.

An element having an atomic number greater than that of boron is used as a filling gas and its filling pressure is up to 2 Torrs.

A discharge current is at least 100 KA and the time to reach 100 KA is up to 1 Sec.

Electric field lenses or magnetic field lenses are combined in such a form as to encompass pinch plasma as a whole.

In other words, the present invention clarifies the conditions such as the electrode structure when used as a high efficiency particle source, the operating gas pressure, the focussing method of particles, and the like, on the basis of the finding that a charged particle flux exists not only in the axial direction but also in the radial direction in a magnitude equivalent to that in the axial direction, under the specific condition. Since a strong magnetic field sufficient to cause magnetic compression exists generally in the radial direction, the charged particles are not believed to fly in the radial direction. In contrast, the present invention deflects the charged particles in the radial direction to the axial direction on the basis of the finding described above, and combines them with the charged particles that originally occur in the axial direction in order to accomplish high efficiency.

High temperature plasma must be formed in order to obtain multi-ionized ions. To accomplish this object, a magnetic compression plasma (hereinafter called "pinch plasma") by large, current discharge is utilized.

Although multi-ionized ions of around 1 KeV at temperature in plasma can be formed by pinch plasma alone, high energy particles having high energy of at least 50 KeV cannot be obtained. To attain high energy, it is necessary to generate a sufficiently high voltage between the electrodes and to reduce sufficiently the plasma density in the accelerating direction of particles or the particles accelerated by the voltage will lose their energy due to collision. The high voltage generation value is determined primarily by the moving velocity of the plasma that contracts due to magnetic compression. To sufficiently elevate or increase the moving velocity, the following methods can be employed; (i) a discharge current providing compression force must have a sufficiently high speed and a sufficiently high current value, and (ii) a plasma pressure to withstand the magnetic compression force must be reduced.

To accomplish the object described above, the following methods are further employed to prevent increase of the particle density of the plasma rod.

(a) The filling gas density is reduced.

(b) The electrodes are disposed asymetrically in the axial direction so that the distribution of the pinch plasma in the axial direction becomes non-uniform and the particles can easily be discharged from the plasma pole.

(c) An element having a large atomic number which provides a large radiation loss is used as the operating gas in order to prevent excessive rise of the plasma temperature.

Collision of the particles after acceleration can be reduced by setting the operating gas pressure to a low level. In addition, it is important to rapidly expand the pinch plasma with a small curvature. To this end, the shape of the electrode is made extremely symmetric in the axial direction.

If the electrode structure is extremely asymmetric in the axial direction, the accelerated particles can discharge from the pinch plasma with a reduced number of times of collision but as a result, the charged particle flux is emitted substantially semi-spherically from the pinch plasma. Therefore, electric field lenses or magnetic field lenses are combined in order to focus the particle flux emitted in the radial direction in one direction and to increase the intensity.

BRIEF DESCRIPTION OF THE DRAWINGS

An embodiment of the invention will be described with reference to the drawing in which.

DESCRIPTION OF THE INVENTION

Figure 1:
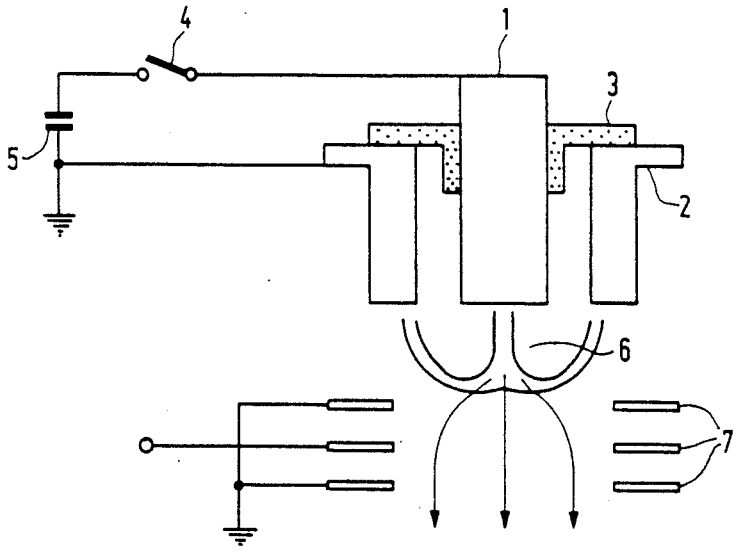
FIG.1 shows an overall construction and a section of a discharge tube in an embodiment of the present invention.

Electrodes 1 and 2 consist of coaxial double cylinders, and the inner electrode 1 does not have any hole at the center, i.e. is a solid cylinder. The outer electrode 2 is a hollow cylinder. An insulator 3 exists between these electrodes 1 and 2. A capacitor 5 is connected to these electrodes 1, 2 through a switch 4. The charging voltage of the capacitor 5 is 2 KeV, for example. Generally, the higher the charging voltage, higher energy particles can be obtained. A filling gas of an element having a large atomic number, such as argon, is filled between the electrodes 1, 2.

When the switch 4 is closed, the charge of the capacitor 5 is discharged through the electrodes 1, 2. Discharge occurs first on the surface of the insulator 3, and a current sheath is driven towards the tip of the electrode 1 due to the interaction between the magnetic field induced by the current itself and the current, that is, the Lorentz force. The current sheath that arrives at the tip of the electrode 1 exhibits an open umbrella-like shape as depicted in the drawing. A high temperature, high density 0 plasma called a "pinch plasma" 6 corresponds to the portion of the shaft of the umbrella. Though the temperature, pressure and density of the pinch plasma 6 are extremely high, the pinch plasma 6 is compressed in a small diameter because the induced magnetic field is sufficiently great. The particles accelerated by the high voltage that occurs with high velocity compression of plasma is discharged at the end portion of the pinch plasma 6, where the current sheath is bent with a small curvature, and are emitted in all directions with substantially a semi-spherical spatial distribution. Whether the plasma consists primarily of electrons or of ions is determined by the polarity of the impressed voltage to the electrode 1. Three discs 7, each having a hole, constitute an electric field lens and focus the particles, that fly in the radial direction, in the axial direction.

To reduce the bending radius of the current sheath at the tip of the pinch plasma 6 in the electrode shape shown in FIG. 1, the inner electrode 1 is arranged in such a fashion that its tip position is on the same level as, or projects from, the tip of the outer electrode 2.

Figure 2:
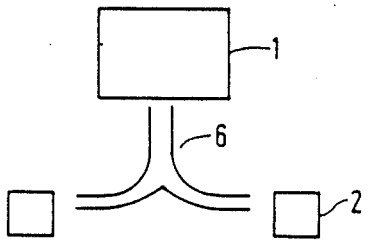
FIG. 2 shows the electrode structure in another embodiment of the invention.

FIG. 2 shows another electrode disposition. Though the electrodes 1 and 2 are disposed in coaxially symmetric relation with each other, they face one another. The electrode 1 has no hole at the center of its discharge end surface, i.e. is solid. On the other hand, the electrode 2 has an annular shape. The pinch plasma 6 is formed in a thinly elongated shape on the axis due to magnetic compression force as shown in the drawing, and its end portion on the side of the electrode 2 is expanded in a disc-like shape so that the high energy particles can easily be discharged from the pinch plasma 6.

Finally, actually measured values are as follows. Namely, the charged flux exhibits a peak value of about 10 KA, a time width of about 200 nS and mean energy of 60 KeV when the charging voltage of the capacitor 5 is 12 KV, the discharge current peak value is 300 KA, ¼ cycle is 2.5 uSec, the filling gas and its pressure are argon and 0.2 Torrs, the inner electrode 1 is 30 mm in diameter, the outer electrode 2 is 80 mm in diameter and the polarity of the inner electrode 1 is negative. The ion flux consists of 16 valent argon at the time of inversion of the polarity, & the peak value is about 5A, the time width is about 300 nSec and the mean energy, about 500 KeV. When the capacitor voltage is changed to 8 KV under the same condition, both the electron flux and the ion flux are so weak that measurement is difficult. Dependence on pressure is such that when the pressure is increased with a capacitor voltage of 12 KV under the same condition as described above, detection cannot be made at a pressure of 0.7 Torrs or above.

In accordance with the present invention, the electron flux or multi-ionized ion flux having high energy and large current can be obtained highly efficiently. For example, when the capacitor voltage is 12 KV, the resulting voltage is about 60 KeV in the case of electrons and about 500 KeV in the case of ions and is higher than the source voltage. In the case of ions, since the multi-ionized ion flux can be obtained easily, these ions can be accelerated by an accelerator better than the monovalent ion. The present invention can easily obtain a large current pulse having a peak value of at least 10 KA in the case of electrons and at least 10 A in the case of ions.

What is claimed is:

1. A charged particle source for providing high energy particles at high currents comprising (a) first and second electrodes disposed in a coaxially symmetric relation and disposed in an axial asymmetric relation, said first electrode having a rod-like shape, and said second electrode having one of a cylindrical or annular shape coaxial with said first electrode, (b) a filling gas sealingly disposed in a space between said first and second electrodes, said filling gas providing a plasma in said space from a tip of said first electrode, said filling gas consisting of an element having an atomic number greater than 5, and said filing gas being under a pressure of at most 0.7 torr, (c) source means for providing a discharge current of at least 100KA in a period of at most 1μsec, said source means being connected between said first and second electrodes, and (d) focussing means for focussing charged particles emitted from said plasma in a radial direction into an axial direction, said focussing means being disposed after said first and second electrodes in said axial direction.

2. A charged particles source according to claim 2, wherein said second electrode has said annular shape disposed beyond said first electrode in said axial direction.

* * * * *